United States Patent [19]

Pierson

[11] Patent Number: 4,955,172

[45] Date of Patent: Sep. 11, 1990

[54] VENEER ANCHOR

[76] Inventor: Neil W. Pierson, 221 N. 7th St., Apt. 7, Mora, Minn. 55051

[21] Appl. No.: 407,209

[22] Filed: Sep. 14, 1989

[51] Int. Cl.[5] ..... E04B 1/38

[52] U.S. Cl. ..... 52/710; 52/379; 52/383; 52/713

[58] Field of Search ..... 52/379, 383, 434, 710, 52/713, 714, 698

[56] References Cited

U.S. PATENT DOCUMENTS

| | | | |
|---|---|---|---|
| 819,869 | 5/1906 | Dunlap . | |
| 1,304,219 | 5/1919 | Thompson | 52/710 |
| 1,474,046 | 11/1923 | Lampert . | |
| 1,725,200 | 8/1929 | Lampert | 52/379 |
| 1,854,633 | 4/1932 | Stephens . | |
| 1,878,921 | 9/1932 | White | 52/711 X |
| 1,988,124 | 1/1935 | Johnson | 72/101 |
| 2,089,253 | 8/1937 | Fitz Gerald | 72/103 |
| 2,898,758 | 8/1959 | Henrickson | 72/101 |
| 3,030,670 | 4/1962 | Bigelow | 20/4 |
| 3,321,883 | 5/1967 | Pascucci | 52/502 |
| 3,341,998 | 9/1967 | Lucas | 52/379 |
| 3,353,312 | 11/1967 | Storch | 52/713 |
| 4,021,990 | 5/1977 | Schwalberg | 52/714 X |
| 4,373,314 | 2/1983 | Allan | 52/434 |
| 4,596,102 | 6/1986 | Catani et al. . | |
| 4,738,070 | 4/1988 | Abbott et al. | 52/710 |

OTHER PUBLICATIONS

DW-19 Series Drywall Veneer Anchoring System (Brochure), Hohmann & Barnard, Inc.

*Primary Examiner*—David A. Scherbel
*Assistant Examiner*—Linda J. Hoffert
*Attorney, Agent, or Firm*—Palmatier & Sjoquist, P.A.

[57] ABSTRACT

The present veneer anchor includes a tie and a plate wherein the lateral movement of the tie relative to the plate is minimized while maintaining a longitudinal sliding motion of the tie relative to the plate. Such lateral movement is minimized by at least two features, including a transverse tie portion with bears against slot-forming edges of the plate and the lateral tie portion which bears against channel-forming inner faces of the plate.

2 Claims, 2 Drawing Sheets

VENEER ANCHOR

The present invention relates to veneer anchors and more particularly to veneer anchors which are mountable to flat surfaces via conventional fastening devices such as screws or nails in stud wall construction, which include anchors with solid backing plates, and which include ties having substantially no lateral or transverse movement relative their respective anchors.

BACKGROUND OF THE INVENTION

A veneer anchor is a device which anchors veneer masonry relative to an adjacent stud wall or dry wall. Veneer anchors provide stability for the brick wall and its interior stud wall construction throughout the 100 or more year life of the brick wall and its respective building.

Veneer anchors typically consist of two parts, a plate and a tie. The plate is secured to the stud wall, and an end of the tie is fastened to the plate. The other end of the tie is set in mortar between bricks and the veneer masonry to anchor the veneer masonry to the stud wall.

The Abbott U.S. Pat. No. 4,738,070 discloses one type of veneer anchor. The anchor includes a base plate with a relatively large space formed between inwardly turned sides. A tie for cooperating with a base plate consists of a pair of legs which are spaced apart to permit a lateral compression of the legs toward each other to clear the legs from contact with the inwardly turned sides without causing the legs to contact each other.

One of the problems with a masonry wall tie unit such as the Abbott unit is that it fails to prevent a lateral movement of the tie relative to the base plate. Such a lateral movement is undesirable because wind driven brick walls may force one of the legs of the tie to disengage from its respective inwardly turned side. In fact, the Abbott patent by its very design encourages such a disengagement by spacing the legs apart to permit compression of the legs.

Another type of anchor is shown in the White U.S. Pat. No. 1,878,921, which is entitled "Anchor" and issued on Sept. 20, 1932. The anchor "relates to means for supporting or anchoring walls, ceilings or other elements of a building to concrete walls, ribs or floors." (See pg. 1, lines 1–4). An object of the anchor "is to provide simple means for insuring the formation of a properly shaped undercut slot in the concrete." (See pg. 1, line 5–8.

The anchoring device of White includes an undercut slot with outwardly flared, lower margins resting on a form (indicated at 19 in the White patent). According to White, a superimposed weight on the undercut slot will tend to spread the sides rather than compress them and any pressure on sides of the undercut slot will be resisted because the outwardly flared margins are resting on the form. (See pg. 1, lines 51–67 and 90–94).

The slot of White cooperates with an anchor consisting of a length of wire doubled on itself to provide an eye, legs arranged in parallelism, and oppositely bent ends of the legs. (See pg. 1, lines 70–75). On the one hand, White provides that "the thickness of the wire will be such that it fits snugly within the pocket so that there is no possibility of play between the anchor and the pocket or undercut slot". (See pg. 1, lines 75–79). On the other hand, White states that "the legs will be normally slightly flared requiring compression in order to seat them in the positions shown in the drawing". (See pg. 1, lines 79–83).

White fails to disclose or suggest an anchoring device mountable to the flat surface of a stud wall. Moreover, White neither discloses or suggests fastening the anchoring device to such a flat surface with conventional devices such as nails or screws. Instead, White discloses an undercut slot which is set in concrete and which will not close upon the hardening of the concrete.

Furthermore, the prior art fails to recognize the problem that wind driven brick walls may undesirably force a movement of the brick wall relative the stud wall. White discloses that "the thickness of the wire will be such that it fits snugly . . . with no possibility of play," and that "the legs . . . be normally slightly flared requiring compression in order to seat them"[emphasis added]. (See pg. 1, lines 75–82). Such language indicates that White failed to recognize the problem of lateral movement of the legs relative to each other and relative to the undercut slot.

SUMMARY OF THE INVENTION

A feature of the present invention is the provision in a veneer anchor with a plate for connection to the exterior surface of a stud wall and with a tie for connection between the plate member and a brick wall, of a pair of U-channels in which prongs of the tie slide vertically with little or no lateral or transverse movement.

Another feature of the present invention is a provision in such a veneer anchor, of a tie with channel-engaging prongs whose ends bear against the insides of the U-channels whereby lateral movement of the tie relative to the plate is limited.

Another feature of the present invention is the provision in such a veneer anchor, of a tie with prongs which bear against each other for their entire lengths and which bear immediately against the inner edges of the slot-forming channels whereby lateral movement of the tie relative to the plate is limited.

Another feature of the present invention is the provision in such a veneer anchor, of a plate with a solid backing and of a tie with prongs of a diameter approximate to the width of the U-channels whereby transverse movement of the tie relative to the plate is limited and whereby the solid backing protects the stud wall from the tie.

An advantage of the present invention is that horizontal movement of the veneer being anchored is minimized and a secure anchoring of the veneer is maximized by the rigid anchoring device which limits lateral and transverse movement of the tie relative to the plate.

Another advantage of the present invention is that the tie is readily slidable up and down in the plate for easy installation and alignment by a mason craftsman even though lateral and transverse movement of the tie relative the plate is minimized.

Another advantage of the present invention is that the stud walls are protected by the solid backing of the plate. High winds have damaged stud walls by driving prior art ties through openings formed in the plate and into the relatively soft dry wall.

Another advantage of the present invention is that it is adaptable to be used with a variety of ties.

Other advantages of the present invention are that it is integral, one-piece, economical, simple to manufacture and easy to install.

DETAILED DESCRIPTIoN OF THE PREFERRED EMBODIMENTS

Figure 1:
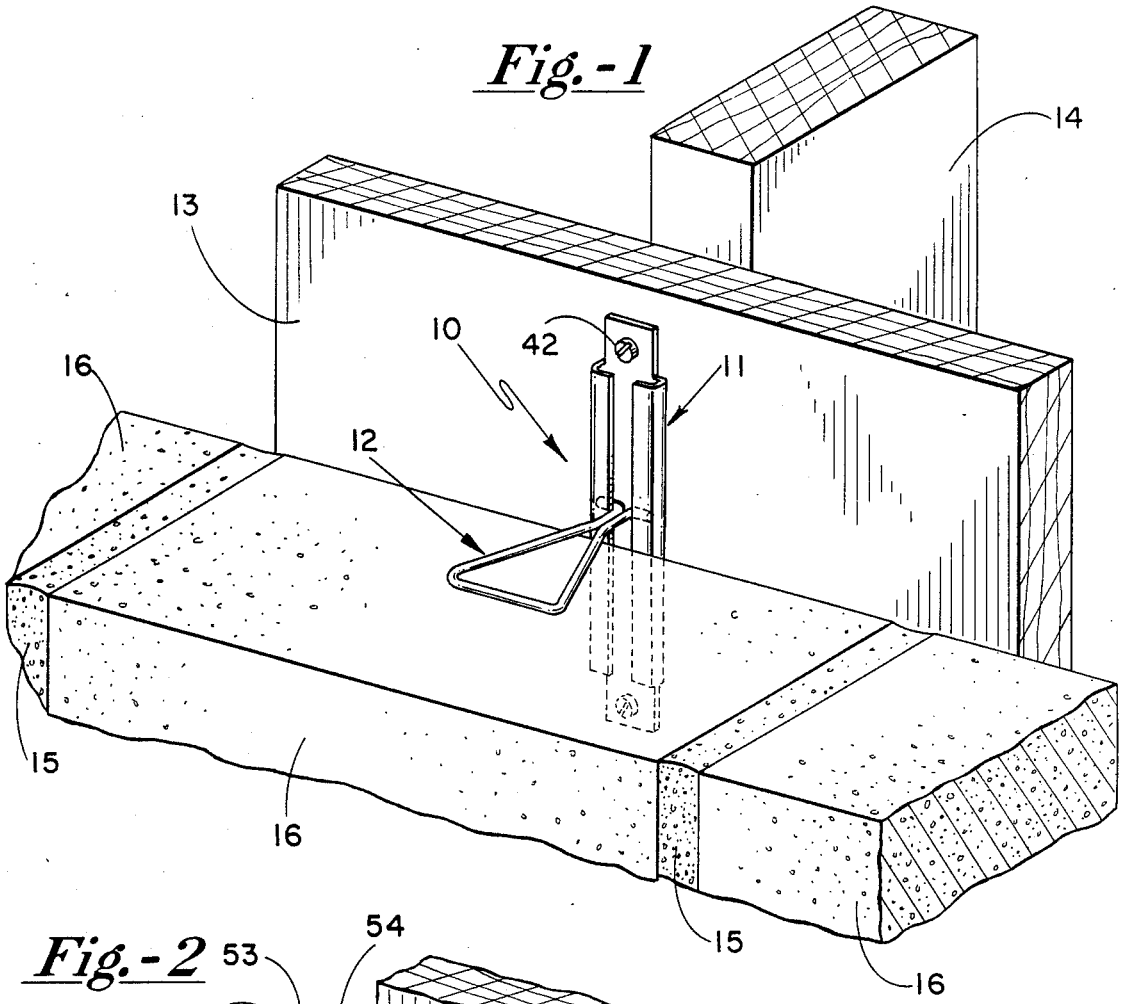
FIG. 1 is a perspective view of the present veneer anchor securing a brick wall to a stud wall.
Figure 2:
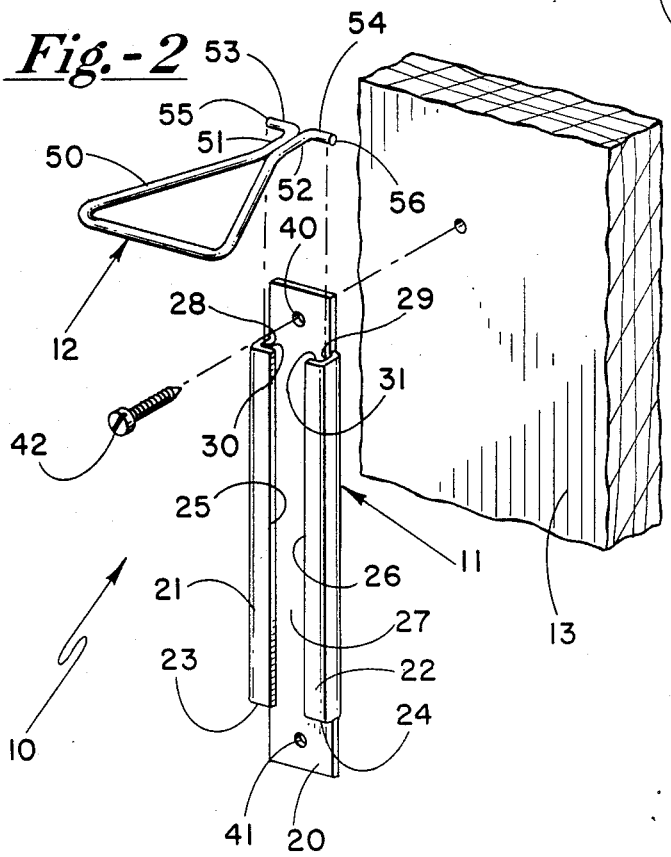
FIG. 2 is an exploded view of the veneer anchor of FIG. 1.

As shown in FIG. 1, the present veneer anchor is indicated in general by the reference numeral 10 and includes a plate 11 and a tie 12. The plate 11 is affixed to a wall covering or stud wall or dry wall 13 and a stud 14. The tie 12 is set in mortar 15 between bricks or concrete blocks or masonry covering 16 and extends from the bricks 16 for connection in the plate 11.

The plate 11 includes a rectangular solid backing 20. The backing 20 is integrally formed with a pair of longitudinally extending angle irons 21–22. The angle irons 21, 22 and the solid backing 20 form a pair of respective U-channels 23, 24. The angle irons 21, 22 further include a pair of respective inner edges 25, 26 which form a slot 27. The angle irons 21, 22 also include a pair of respective inside opposing first faces 28, 29 and a pair of second faces 30, 31 which oppose a solid backing 20.

The solid backing 20 forms a pair of upper and lower holes 40, 41 for receiving fastening means or pin connector such as a screw 42. Nails or like fastening means may be utilized for securing the plate 11 to the dry wall 13. The holes 40, 41 are spaced from the angle irons 21, 22 and the tie 12 disposed therein. One reason for such a spacing is to allow ready connection of the plate 11 to the dry wall 13 and stud 14. Another reason for such a spacing is that holes disposed between the angles irons 21, 22 may weaken the solid backing 20 therebetween and may undesirably provide a starting point for a splitting of the plate 11 if, for example, wind drives the tie 12 against an unused screw hole or a screw disposed in a hole.

Figure 6:
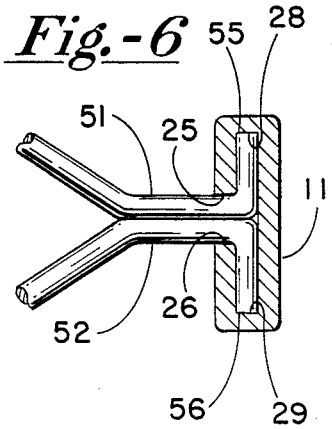
FIG. 6 is a detail section view of a portion of the veneer anchor of FIG. 1.
Figure 3:
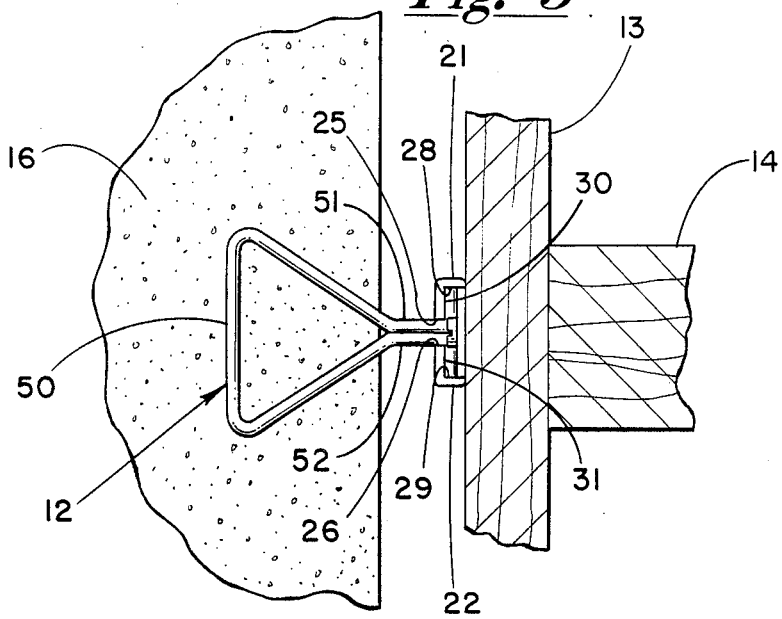
FIG. 3 is a top plan view of the veneer anchor of FIG. 1.
Figure 4:
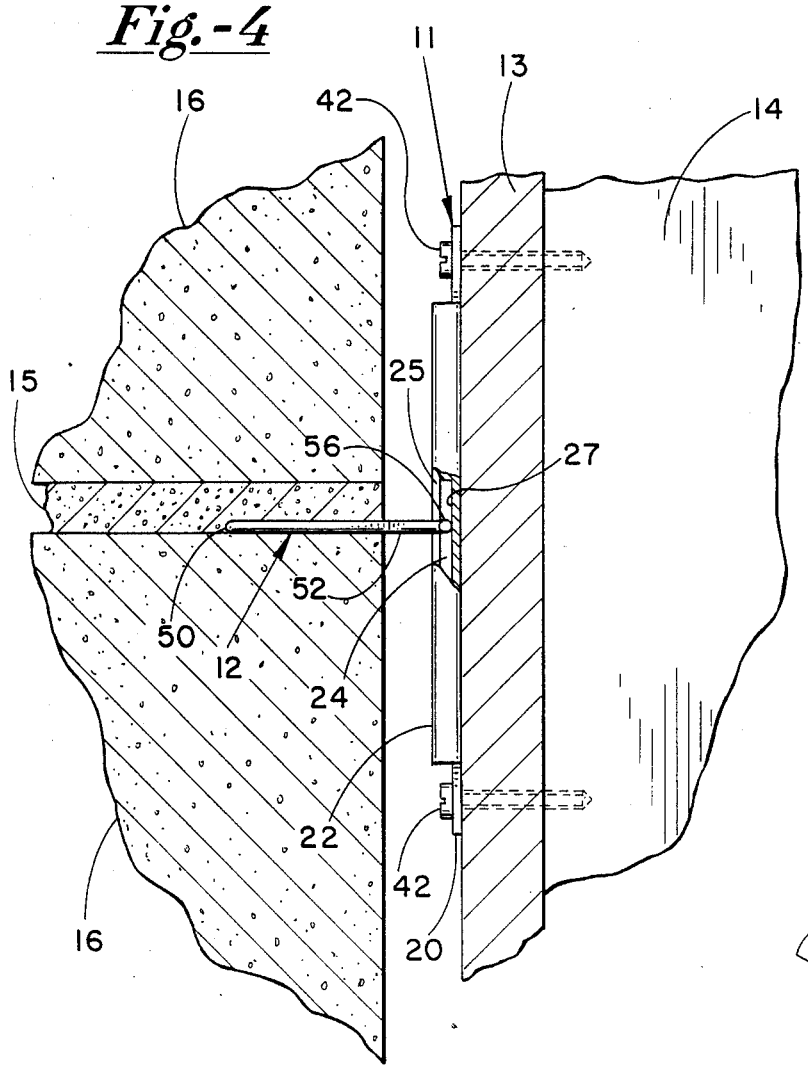
FIG. 4 is an elevational, partially cut away view of the veneer of FIG. 1.

The tie 12 is rigid and integral and includes a triangular rod portion 50, a pair of shank-like transverse rod portions 51, 52 and a pair of lateral rod portions 53, 54 with respective outer ends 55, 56. The inner sides of the transverse rod portions 51, 52 bear against each other. The thickness of both of the transverse rod portions 51, 52 or the width of the shank is substantially the same as the width of the slot 27. The distance between ends 55, 56 is substantially the same as the distance between faces 28, 29 which form portions of the U-channels 23, 24. The diameter of the lateral rod portions 53, 54 is substantially the same as the distance between inner lateral faces 30, 31 and the solid backing 20. (See FIG. 6)

In operation, the plate 11 is affixed at the appropriate height to the wall covering 13 and stud 14 with the screws 42. Subsequently, the prongs 53, 54 of the tie 12 are slid into the plate 11 via the channels 23, 24 until the triangular rod portion 50 is brought to bear on one of the bricks 16. As the tie 12 slides in plate 11, the outer edges of transverse rod portions 51, 52 bear against inner edges 25, 26 of the integral angle irons 21, 22 and the ends 55, 56 of the prongs 53, 54 bears against the inside opposing transverse faces 28, 29 of the angle irons 21, 22. The front and rear edges of the prongs 53, 54 also bear against the front surface of the plate 20 and the inside lateral faces 30, 31 of the angle irons 21, 22 to prevent transverse movement of the tie 12 relative to the plate 11. When the triangular rod portion 50 is disposed at its desired height relative the bricks 16, the triangular rod portion 50 is set in the mortar 15 and one of the bricks 16 is laid on the mortar 15 on top of the tie 12.

Instead of sliding the prongs 53, 54 to their appropriate height in the channels 23, 24 with the prongs 53, 54 extending in a horizontal direction, the prongs 53, 54 may be disposed vertically and inserted in such a position into the slot 27 at the desired height. Subsequently, the tie 12 is turned so that the prongs 53, 54 are disposed horizontally in the channels 23, 24. After the tie 12 is turned, the outer edges of the transverse rod portions 51, 52 bear against the inner edges 25, 26 of the angle irons 21, 22 and the ends 55, 56 of the prongs 53, 54 bear against the inside faces 28, 29 of the angle irons 21, 22. The front and rear edges of the prongs 53, 54 also bear against the front surface of the plate 20 and the inside faces 30, 31 of the angle irons 21, 22 to prevent transverse movement of the tie relative to the plate 11.

Solid backing 20 of the plate 11 prevents the prongs 53, 54 or any other portion of the tie 12 from being driven into the wall covering 13. Wind is an example of a force which may drive the prongs 53, 54 transversely against the solid backing 20 of the plate. Shifting or the natural settling of a brick wall are other examples of forces which may bring pressure to bear on the plate 11 via the tie 12.

Wind and the shifting and settling of brick walls also drive the tie 12 laterally relative to the plate 11. When such movement occurs, ties in some prior art devices have been dislodged from their respective plates. When such lateral movement occurs in the present invention, the tie 12 and plate 11 remain connected. Specifically, the outer edges of the transverse rod portions 51, 52 bear against the inner edges 25, 26, and the outer ends 55, 56 bear against the inside opposing faces 28, 29 to prevent such lateral movement.

Figure 5:
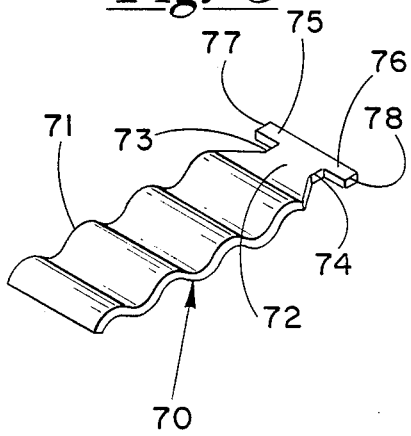
FIG. 5 is a view of an alternate embodiment of the tie of the veneer anchor.

In an alternate embodiment of the invention, as shown in FIG. 5, an integral tie 70 includes a rippled plate portion 71, a shank portion 72 with abutting edges 72, 74 and a pair of bar-like prongs 75, 76 with a pair of respective abutting ends 77, 78. Ties 12 and 70 are connected to plate 11 in substantially the same fashion. With tie 70, abutting edges 73, 74 abut inner edges 25, 26 of the plate 11 and abutting ends 77, 78 abut inside faces 28, 29 of the plate 11 to limit lateral movement between the tie 70 and plate 11. The thickness of each of the prongs 75, 76 is substantially the same as the depth of the channels 23, 24 so as to minimize transverse movement between the tie 70 and plate 11.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A veneer anchor for securing masonry veneer to the exterior surface of a wall and a stud behind the wall, the veneer anchor comprising:

a rectangular integral plate with a solid backing, upper and lower portions, and side portions, each of the upper and lower portions including a pin receiving aperture formed therein, the solid backing including a front face, the solid backing bearable against the exterior surface of the wall, a pair of pin connectors, each of the pin connectors cooperating with one of the pin receiving apertures for securing the plate to the exterior surface of the wall and the stud behind the wall.

a pair of longitudinally extending angle irons integrally connected to the side portions of the plate and extending inwardly therefrom, the angle irons disposed between the upper and lower portions of the plate so as to be spaced from the pin receiving apertures, each of the angle irons including a longitudinal inner edge, the inner edges forming a longitudinally extending slot, the slot being aligned with the pin receiving apertures, each of the angle irons further including a transverse inner face, and a lateral inner face which form a channel with the front face of the solid backing, and an integral rigid tie including a triangular rod portion for being set in the masonry veneer, a pair of non-compressible transverse rod portions bearing against each other for their entire lengths, and a pair of lateral rod portions extending away from each other, each of the lateral rod portions having an end, the combined width of the transverse rod portions being substantially equal to the width of the slot so that lateral movement between the transverse rod portion and slot is minimized, the distance between the ends of the lateral rod portions being substantially equal to the distance between the transverse inner faces so that lateral movement between the lateral rod portions and transverse inner faces is minimized, the diameter of the lateral rod portions being substantially equal to the distance between the lateral inner faces of the angle irons and the front face of the solid backing so that transverse movement of the lateral rod portions relative to the angle irons is minimized whereby lateral and transverse movement of the tie relative the plate is minimized.

2. A veneer anchor for securing masonry veneer to the exterior surface of a wall and a stud behind the wall, the veneer anchor comprising:

a rectangular integral plate with a solid backing, upper and lower portions, and side portions, each of the upper and lower portions including a pin receiving aperture formed therein, the solid backing including a front face, the solid backing bearable against the exterior surface of the wall, a pair of pin connectors, each of the pin connectors cooperating with one of the pin receiving apertures for securing the plate to the exterior surface of the wall and the stud behind the wall, a pair of longitudinally extending angle irons integrally connected to the side portions of the plate and extending inwardly therefrom, the angle irons disposed between the upper and lower portions of the plate so as to be spaced from the pin receiving apertures, each of the angle irons including a longitudinal inner edge, the inner edges forming a longitudinally extending slot, the slot being aligned with the pin receiving apertures, each of the angle irons further including a transverse inner face, and a lateral inner face which form a channel with the front face of the solid backing, and an integral rigid tie including a rippled plate portion for being set in the masonry veneer, a transversely extending shank plate portion, and a pair of laterally extending bar-shaped prongs, each of the laterally extending bar-shaped prongs having an end, the width of the transversely extending shank plate portion being substantially equal to the width of the slot so that lateral movement between the shank plate portion and slot is minimized, the distance between the ends of the bar-shaped prongs being substantially equal to the distance between the transverse inner faces so that lateral movement between the bar-shaped prongs and transverse inner faces is minimized, the width of the bar-shaped prongs being substantially equal to the distance between the lateral inner faces of the angle irons and the front face of the solid backing so that transverse movement of the bar-shaped prongs relative to the angle irons is minimized whereby lateral and transverse movement of the tie relative the plate is minimized.

* * * * *

UNITED STATES PATENT AND TRADEMARK OFFICE

CERTIFICATE OF CORRECTION

PATENT NO. : 4,955,172

DATED : September 11, 1990

INVENTOR(S) : Neil W. Pierson

It is certified that error appears in the above-identified patent and that said Letters Patent is hereby corrected as shown below:

Column 2, line 13, underline the word "thickness".

Column 2, lines 15 and 16, underline the word "requiring".

Column 3, line 10, after the word "veneer" and before the word "of", insert --anchor--.

Column 3, line 15, in the title, delete "DESCRIPTIoN" and replace it with --DESCRIPTION--.

Signed and Sealed this

Seventeenth Day of March, 1992

*Attest:*

HARRY F. MANBECK, JR.

*Attesting Officer*

*Commissioner of Patents and Trademarks*